United States Patent [19]

Mazzorana

[11] 4,305,305

[45] Dec. 15, 1981

[54] ACTUATORS FOR ELECTRIC STARTERS

[75] Inventor: Alfred B. Mazzorana, Venissieux, France

[73] Assignee: Societe de Paris et du Rhone, Lyon, France

[21] Appl. No.: 122,350

[22] Filed: Feb. 19, 1980

[30] Foreign Application Priority Data

Feb. 21, 1979 [FR] France ..... 79 05112

[51] Int. Cl.[3] ..... F02N 15/06

[52] U.S. Cl. ..... 74/7 A; 74/6; 74/104

[58] Field of Search ..... 74/6, 7 R, 7 A, 104; 290/38 R, 38 C; 192/98

[56] References Cited

U.S. PATENT DOCUMENTS 3,177,728 4/1965 Farison ..... 74/7 A
3,293,924 12/1966 Costelli ..... 74/6
3,299,719 1/1967 Toulier ..... 74/7

FOREIGN PATENT DOCUMENTS 297139 5/1954 France ..... 74/7 A

*Primary Examiner*—Allan D. Herrmann
*Attorney, Agent, or Firm*—Dowell & Dowell

[57] ABSTRACT

The present invention relates to an actuator for an electric starter, comprising a thin sleeve of which the periphery comprises two flanges between which a two-piece collar is placed. The lugs of this collar engage in a notch in the lever to prevent rotation of the sleeve. The invention finds particular application in the automobile industry.

6 Claims, 7 Drawing Figures

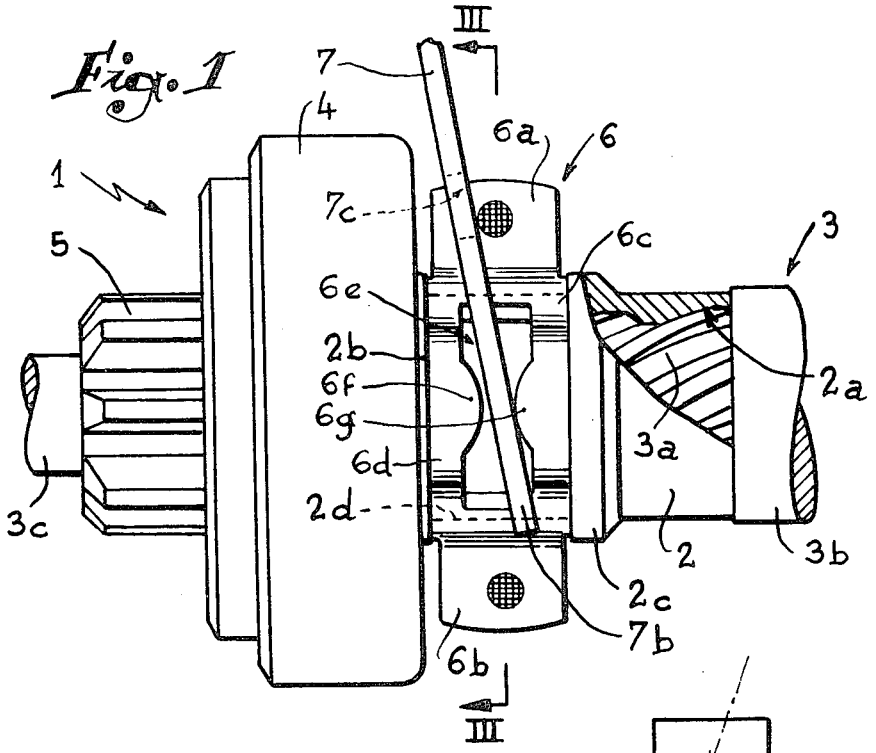
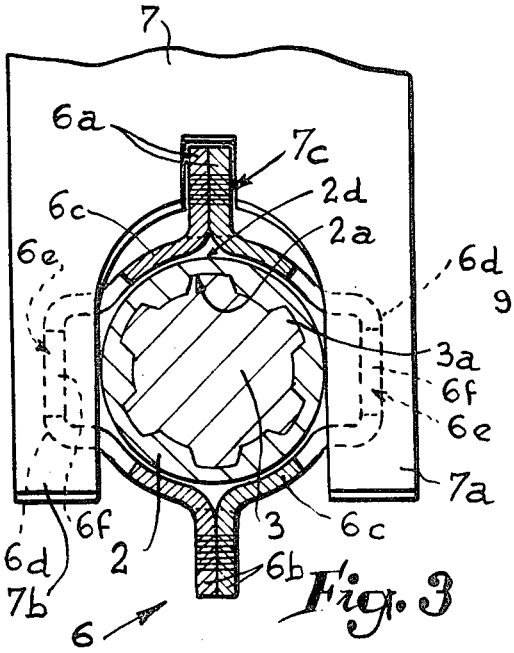
Fig. 3
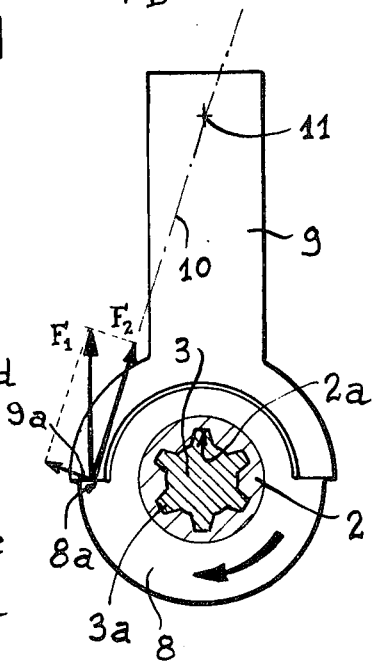
Fig. 4

Fig. 5
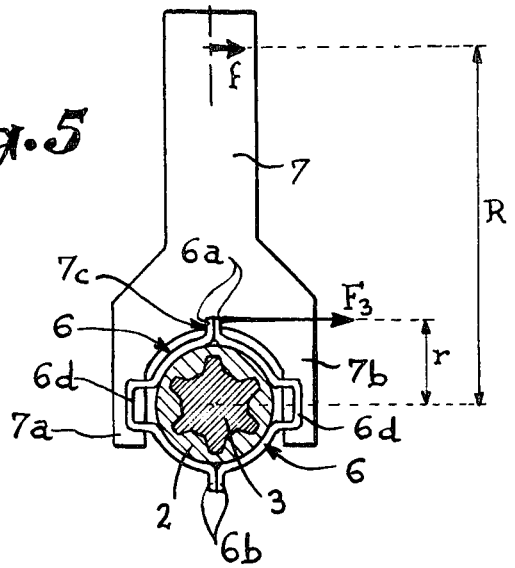
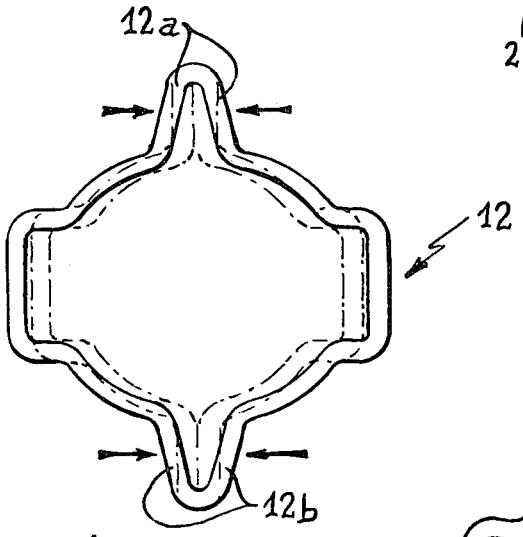
Fig. 6
Fig. 7
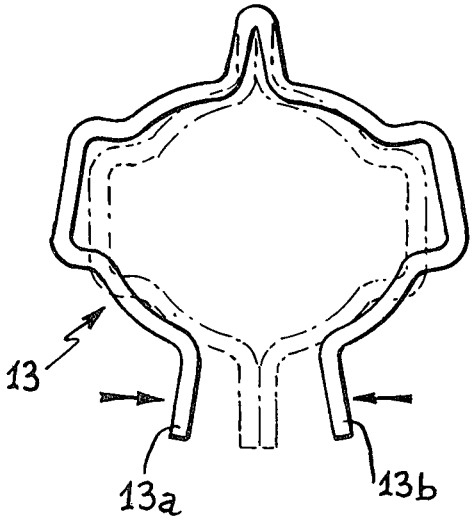

ACTUATORS FOR ELECTRIC STARTERS

The present invention relates to improvements in actuators of starters for internal combustion engines, which are more particularly, but not exclusively, intended to be actuated by a lever composed of a wire or a flat iron piece.

Each device of the type in question must comprise means for ensuring the axial abutment of the connecting collar between its acutating lever and its grooved sleeve, whilst other means ensure the holding of said collar against rotation.

The holding of this collar member against rotation in conventional actuators is generally effected by a transverse stop which acts on one of the arms of the fork of the actuating lever, creating a torque thereon. Means must therefore be provided for counteracting the resultant of this torque at the level of the articulation of the fork to the core of its solenoid control contactor. For example, the guiding of the latter is necessary to avoid it being driven transversely with respect to the geometrical axis of said contactor. This guiding produces considerable undesirable frictions so that the power of the contactor must be considerably increased.

The connecting collar member between the fork of the lever and the sleeve of the actuator must comprise means ensuring its axial positioning with respect to the tubular sleeve of said actuator whose bore cooperates with the grooves of the shaft. For reasons of ease of assembly, this holding is consitituted on the one hand by a shoulder and on the other hand by means of a split ring, circlips or the like. The positioning of this latter system makes it necessary to have a sufficiently thick tubular sleeve to allow its positioning circlip groove to be made, with the result that its cost price is fairly high due to the weight of the piece and the machining that it must undergo.

It is an object of the improvements according to the present invention to remedy these drawbacks by providing an actuator comprising a thin sleeve with two shoulders between which is mounted the improved connecting collar member also forming the subject matter of the invention, this member being positioned and stopped in rotation by cooperation with the lever actuating the actuator.

The advantages obtained due to this invention consist in allowing an actuator of low cost price to be produced, comprising a sleeve also constituting a breaking piece which in the case on an abnormally high torque applied to-said actuator which breaking piece, avoids the damaging of the starting system. Morever, the plunger of the contactor undergoes a greatly reduced torque transmitted by the lever, so that the parasitic frictions are reduced and the useful power of said contactor accordingly increased.

The invention will be more readily understood on reading the following description with reference to the accompanying drawings, in which:

FIG. 1 is a view in elevation, with parts broken away, of an actuator comprising the improvements according to the invention;

FIG. 3 is a section along III—III (FIG. 1).

FIG. 4 illustrates the components of force exerted on the fork in the case of an offset angular holding of the type shown in the prior art.

FIG. 5 shows how the arrangement according to the invention reduces the effort on the core of the contactor.

FIGS. 6 and 7 are views of collars according to variant embodiments.

Figure 2:
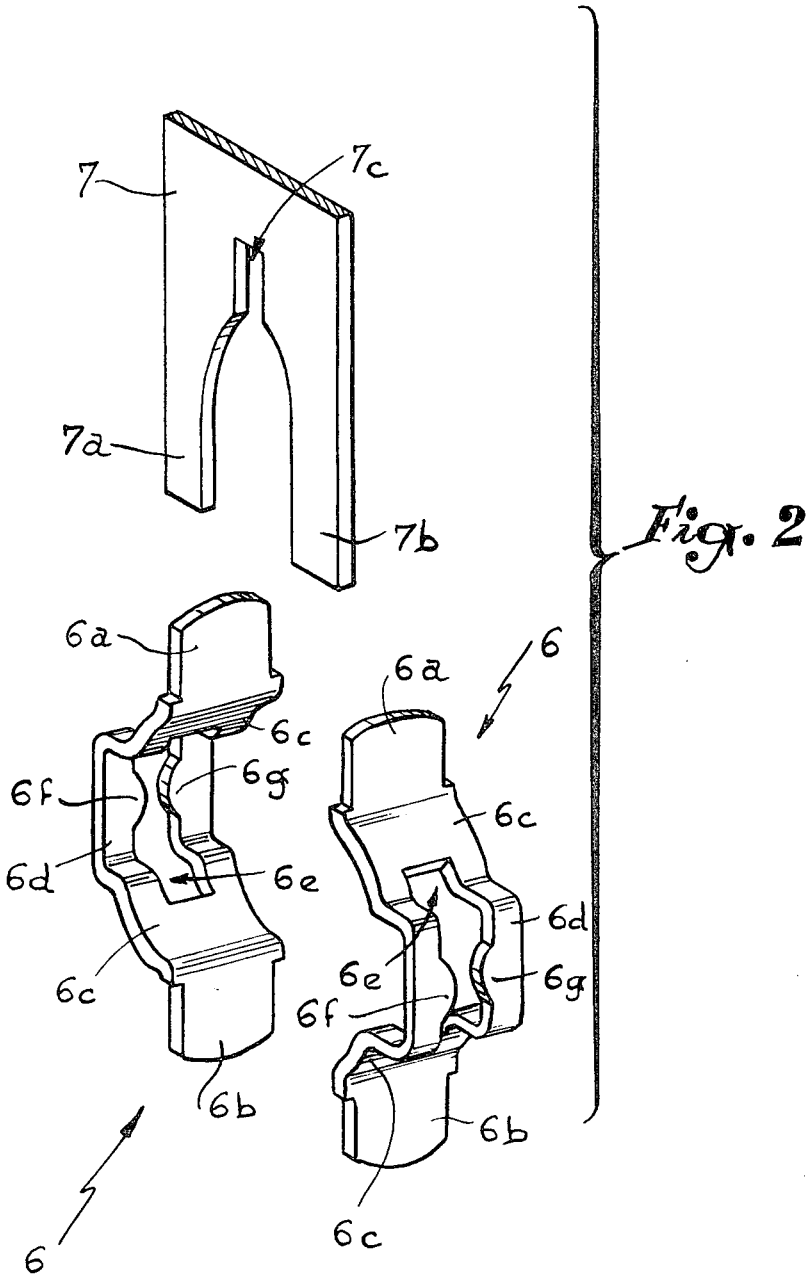
FIG. 2 is an exploded view in perspective of the fork of the actuating lever and of its connecting member with the actuator.

Referring now to the drawings, FIG. 1 shows an actuator 1 for the electric starter of an internal combustion engine, comprising, in conventional manner, a tubular sleeve 2 itself provided with inner helical grooves 2*a* adapted to cooperate with grooves 3*a* made on the shaft 3 of the motor of the starter. The sleeve 2 is unitary with a free wheel 4 bearing a pinion 5 adapted to drive the crown wheel (not shown) of an internal combustion engine. The grooved part 3*a* is terminated by a part 3*b* of greater diameter which determines a shoulder against which the sleeve 2 abuts in rest position. The shaft 3 further comprises a smooth endpiece 3*c* which follows its grooved part 3*a*.

The periphery of the sleeve 2 is provided with two flanges 2*b*, 2*c* which determine therebetween a cylindrical bearing surface 2*d* of smaller diameter.

A collar 6 which is shown in greater detail in FIG. 2 is engaged around the bearing surface 2*d* in question. This collar is made by means of two identical pieces each comprising two lugs 6*a*, 6*b* located opposite each other and which are connected by a rounded web 6*c* comprising a lateral ear-shaped portion 6*d*. The latter is divided by a slot 6*e* which also extends to the two parts of the web adjacent the ear-shaped portion in question. The edges of the slot located at the centre of the ear 6*d* comprises rounded stops 6*f*, 6*g* disposed opposite each other and which extend inside said slot.

The two pieces of the collar are placed around the bearing surface 2*c* (FIG. 3) of the sleeve 2, the lugs 6*a*, 6*b* being connected in two's, for example by spot welding. The collar is thus placed around the sleeve before heat treatment thereof so that these two elements are treated together.

The lever actuating the collar 6 which has been given general reference 7, is made from a flat iron piece whose lower part comprises a fork with two arms 7*a*,7*b* (FIG. 2). The arms engage respectively in the slots 6*e* of the halves of the collar so that one of their faces comes into abutment against one of the stops 6*f*, 6*g*. Thus, as shown in FIG. 1, i.e. in rest position of the actuator 1, the arms of the fork of the lever 7 are in abutment against the stops 6*g*.

The two upper lugs 6*a* of the collar 6, once joined, engage in a notch 7*c* made radially in the central part of the lower fork of the lever 7 and along the geometrical axis thereof. This assembly avoids the rotation of the collar when the sleeve of the actuator is displaced while rotating along the grooved part 3*a* of the shaft 3.

When the sleeve is a conventional one, such as 8 in FIG. 4 and which comprises an offset support 8*a* coming into contact with a corresponding face 9*a* of the arm of a forked actuating lever 9, the force F1 produced by the action of the sleeve 8 which tends to be driven in rotation is broken down into two forces, but especially into a force F2 very slightly weaker than force F1.

This force F2 passes through the articulation 11 of the core of the solenoid contactor. The latter therefore undergoes a considerable transverse force which must be counteracted as has been explained hereinabove if the lever is not supported on a pivoting axis.

On the contrary, in the device according to the invention (FIG.5), the force f which is applied on the lever 7 at point 11 of the articulation of the solenoid contactor is reduced in the ratio r/R (r being the distance separating the point of application of the force F3 from the geometrical axis of the shaft, said force F3 being substantially equal to the above force F2; R being the distance separating the point 11 defined hereinabove from the geometrical axis of the shaft). In an apparatus of known type, it may be admitted that the force f is four to five times smaller than F3 or F2. Thus, the reaction at the point 11 of contacting said core is so little that it does not require to be counteracted by means supplementary to the normal means for guiding this core.

Finally, using this mode of fixing the collar 6 between two flanges, it is possible to reduce the thickness 2*e* of the sleeve to a minimum so that it is more economical and may constitute a breaking piece in case the actuator experiences an abnormally high torque.

The preceding description has, of course, only been given by way of non-limiting example and the replacement of details of execution described by any other equivalents would not depart from the scope of the invention. In particular, the collar 6 could be made in one piece 12 so that its web presents a passage larger than the diameter of the flange 2*c* (FIG. 6). It would then be deformed to close its lugs 12*a*, 12*b* so that it can be held between the two flanges before undergoing its heat treatment. Said collar 6 could also be made of one piece 13 as defined hereinabove but two of its lugs 13*a*, 13*b* being separated (FIG. 7) to allow the collar to open and pass on the flange 2*c*, said lugs being tightened after assembly then welded as described hereinabove.

What is claimed is:

1. An actuator for a starter for an internal combustion engine, the starter having a shaft with a toothed portion surrounded by a toothed sleeve slidable thereon to engage the starter, and having a solenoid-actuated lever having a forked portion in the vicinity of the sleeve and operative to slide the sleeve on the shaft, the improved actuator comprising on the sleeve an external bearing surface having an annular flange extending from the bearing surface at each end thereof;

a collar surrounding the bearing surface and confined thereon by said flanges, the collar having stops thereon, and the forked portion of the lever straddling the collar and being longitudinally confined between the stops; and the collar having a lug thereon extending radially therefrom toward the lever, and the lever having a notch therein to receive the lug and confine it in the notch, whereby to prevent rotation of the collar relative to the lever.

2. The actuator as claimed in claim 1, wherein the lever has an axis of symmetry, and the notch is centered about said axis.

3. The actuator as claimed in claim 1, wherein the collar is formed in one piece deformed to surround the bearing between the flanges.

4. The actuator as claimed in claim 1, wherein the collar is made of two pieces having abutting lugs joined together when the two pieces surround the bearing surface of the sleeve.

5. The actuator as claimed in claim 1 wherein the sleeve wherein the sleeve and the collar comprises a heat treated subassembly of parts.

6. The actuator as claimed in claim 1, wherein the thickness of the sleeve is selected to provide it with breaking-piece characteristics to protect the actuator from abnormally high torques.

* * * * *